US006544015B1

(12) United States Patent
Kaechele

(10) Patent No.: US 6,544,015 B1
(45) Date of Patent: Apr. 8, 2003

(54) WORM FOR AN ECCENTRIC SCREW PUMP OR A SUBSURFACE DRILLING MOTOR

(75) Inventor: Bruno Kaechele, Weilheim/Teck (DE)

(73) Assignee: Wilhelm Kaechele GmbH Elastomertechnik, Wilhelm/Teck (DE)

( * ) Notice: Subject to any disclaimer, the term of this patent is extended or adjusted under 35 U.S.C. 154(b) by 0 days.

(21) Appl. No.: 09/831,561

(22) PCT Filed: Sep. 21, 1999

(86) PCT No.: PCT/DE99/03007

§ 371 (c)(1),
(2), (4) Date: May 11, 2001

(87) PCT Pub. No.: WO00/29750

PCT Pub. Date: May 25, 2000

(30) Foreign Application Priority Data

Nov. 13, 1998 (DE) ..... 198 52 380

(51) Int. Cl.[7] ..... F01C 1/10

(52) U.S. Cl. ..... 418/48; 417/307; 416/241; 175/107

(58) Field of Search ..... 418/48; 175/107; 416/241; 417/307

(56) References Cited

U.S. PATENT DOCUMENTS 2,463,341 A * 3/1949 Wade ..... 418/48
5,090,497 A * 2/1992 Beimgraben et al. ..... 418/48
5,310,320 A * 5/1994 Timuska ..... 416/241
5,472,319 A * 12/1995 Rohlfing et al. ..... 417/307

FOREIGN PATENT DOCUMENTS

| | | | |
|---|---|---|---|
| AU | 67510 | * 10/1975 | ..... 418/48 |
| DE | 12 89 433 | 2/1969 | |
| DE | 1816462 | 7/1970 | |
| DE | 17 03 828 | 12/1971 | |
| DE | 2713468 | * 9/1978 | ..... 418/48 |
| DE | 195 01 514 | 7/1996 | |
| EP | 0 457 925 | 11/1991 | |
| GB | 620901 | * 3/1949 | ..... 418/48 |
| GB | 620 901 | 4/1949 | |
| JP | 04-353283 | * 12/1992 | ..... 418/48 |
| WO | WO 91 17012 | 11/1991 | |

* cited by examiner

*Primary Examiner*—Thomas Denion
*Assistant Examiner*—Theresa Trieu
(74) *Attorney, Agent, or Firm*—Foley & Lardner

(57) ABSTRACT

A rotor (4) for an eccentric screw pump or a subsurface drilling motor consists of a straight, essentially cylindrical core element (21), onto which a shell (22) is forged by a cold-forging process. The forging gives the shell (22) the helical external form required for eccentric screw pumps (1). The rotor (4) described can be produced by non-cutting shaping, which is of considerable advantage in particular in the case of large rotor dimensions, since no waste material is produced.

28 Claims, 4 Drawing Sheets

WORM FOR AN ECCENTRIC SCREW PUMP OR A SUBSURFACE DRILLING MOTOR

BACKGROUND OF THE INVENTION

Eccentric screw pumps are used for the delivery of media capable of flowing in a viscous state, in particular media which are highly abrasive. The eccentric screw pumps consist of a stator having a through-opening. The inner wall of the through-opening is in the form of a multiple-start thread and is formed by an elastomer. The elastomer is located in a tubular shell made of high-strength material, for example steel, in which case the inner contour of the shell is either cylindrically smooth or follows the thread contour of the through-bore at a constant radial distance. Rotating in the through-bore of the stator is a rotor, the number of helices of which is one less than the number of thread helices in the through-bore. The rotor is made of a strong material and has an especially high abrasion resistance.

In the case of an eccentric screw pump, the rotor is driven from outside via a motor and it delivers through the through-bore in interaction with the stator. During the rotation of the rotor, crescent-shaped or banana-shaped chambers, in the widest sense, are produced in interaction with the inner wall of the through-bore, and these chambers gradually pass through the stator during the rotation of the rotor.

Such arrangements may also be used as a motor if the liquid is forced through the arrangement at high pressure. The pressure of the liquid sets the rotor in rotation and mechanical energy can be tapped at the rotor. Use is made of this arrangement, for example, in subsurface drilling motors.

The production of the stators is comparatively simple. They are vulcanized via a mold core and in this way are given the complicated shape of the through-opening. On the other hand, the production of the rotors has hitherto been more difficult, these rotors hitherto being produced from the solid material by machining processes.

It is certainly known from DE-A-1 703 828 to forge the rotor from a tube. Rotors of this type are not sufficiently dimensionally stable in the axial direction at high driving forces or high pressures, as occur in subsurface drilling motors. The driving torque leads, inter alia, to the rotor becoming twisted on account of its helical form and being shortened in the process. The result is that the calculated pitch of the rotor no longer corresponds to the calculated thread pitch of the multiple-start thread in the stator and leakages occur, which lead to pressure losses and thus to power losses.

Another type of construction of a rotor has been disclosed by DE-A-195 01 514. The rotor is composed of a shell and a core element contained in the shell. The shell is produced from a cylindrical tube by cold working. In this case, a drawing tool is pulled through the cylindrical tube, as a result of which the tube is given the helical form required for the rotor. The core element is subsequently loosely inserted in the shell thus produced and is connected to the tube at both ends.

However, it has been found that the accuracy to size at the outside of the shell is not sufficient and the shell has to be subjected to a secondary treatment. In addition, the known rotor twists to a relatively high degree due to its lack of torsional strength. The torsion leads to a change in the thread pitch [lacuna] thus to a pitch error relative to the stator, a factor which in turn adversely affects the sealing relative to the stator.

Described in DE-D-18 16 462 is a rotor whose shell consists of a ceramic mass. A steel shaft likewise passes through the hollow shell, the intermediate space between the inside of the shell and the steel shaft being filled with a bonding agent.

SUMMARY OF THE INVENTION

Starting therefrom, the object of the invention is to provide a rotor for an eccentric screw pump or an eccentric screw motor, for example a subsurface motor, which can be produced from [sic] in a comparatively cost-effective manner and is torsionally stable. This object is achieved according to the invention by the rotor having the features of claim 1.

In the novel rotor, a core element which is encased by a shell is used. On its outside, the shell forms the thread-shaped structure, i.e. the helically running area. In this way, the shell can be produced by cold working in a relatively cost-effective non-cutting manufacturing process. Located in the interior of the shell is a core element which runs through the shell over the entire length of the latter and gives the shell the requisite axial stability.

In this way, rotors may also be produced from materials which, although they are ductile, are difficult to machine, such as high-grade steels, e.g.

V2A or V4A steels. On the other hand, the core element can be made of a lower-grade steel.

As a result of the helical form of the shell, this shell, under the effect of the torque, could theoretically change in length in the manner known from the prior art if it is twisted. The use of the core element prevents the shell from being axially shortened in this way.

The core element may be a simple body which is cylindrical on the outside and is very simple and inexpensive to produce.

Since the shell is forged onto the core element in the case of the rotor according to the invention, a very strong connection is produced between the core element and the shell. This strong connection improves the torsional strength and also helps to ensure that the length of the rotor virtually does not change to a significant degree even under loading.

The forming of the shell onto the core element also brings about the advantage that the surface of the rotor no longer has to be reworked. The forming gives it its final and smooth surface, which, moreover, is bright if the forming takes place by cold working.

At the same time, the cold working has the further favorable secondary effect that the pitch of the rotor does not change, as would be the case of a hot forging process were to be used. In the case of hot forging, the change in length occurring during the cooling would have to be taken into account in a short time ago [sic].

The entire structure can thus be produced by non-cutting shaping.

The shell mounted on the core element has essentially the same wall thickness over its entire length and its circumference, i.e. it is approximately of the same thickness at every point.

The core element is in contact with the shell only in sections. These sections are regions of the thread valleys of the shell. In the region between the thread valleys, that is to say [lacuna] the thread crests of the shell, there are intermediate spaces between the core element and the shell. These intermediate spaces have the form of a single-or multiple-start screw.

During the cold working of the shell, it is possible for the shaping to be carried out only to the extent that the thread valleys of the shell only just touch the core element. The connection between the core element and the shell is then virtually a frictional connection.

However, it is possible to have the cold working carried out to such an extent that the core element is also shaped or the wall thickness of the shell at the contact point with the core element changes slightly. The connection with the core element is then also a positive-locking connection to a certain degree in this region, and it can also become an integral connection as a result of cold welding.

An especially torsionally resistant connection between the core element and the shell is achieved if the core element, at least in one section of its longitudinal extent, contains at least one groove which has a different course from the thread valley. An appropriate position of this groove relative to the thread valley enables the shell to be forged into this groove of the core element during the manufacturing process. Since the direction of this groove differs from the course of the thread valley, this reliably prevents the shell from being unscrewed from the core element along the screw formed by the thread valley.

Especially effective locking is achieved if the core element has at least one groove which is continuous over its entire axial length. In this case, the production of the core element becomes very simple if this groove follows the generating line.

As viewed in the circumferential direction, the groove expediently has a width as corresponds approximately to the contact region between the inside of the shell in the region of the thread valley and the core element. The depth of the groove is between 0.1 to 1.5 mm, about 0.5 mm has proved to be expedient.

It is favorable if the core element has a plurality of grooves.

The rotor according to the invention may have wall thicknesses of between 2 and 20 mm at an overall diameter of between 30 and 300 mm. The length of the novel rotor may be up to 8 m.

In order to connect the coupling head to the rotor, the core element, at one end, has a stem projecting beyond the shell. This stem is expediently designed as a threaded stem.

The rotor according to the invention can be used in eccentric screw pumps or arrangements which are used as motors, for example subsurface drilling motors.

Apart from that, developments of the invention are the subject matter of subclaims.

BRIEF DESCRIPTION OF THE DRAWINGS

An exemplary embodiment of the subject matter of the invention is shown in the drawing, in which.

DETAILED DESCRIPTION OF PREFERRED EMBODIMENTS

Figure 1:
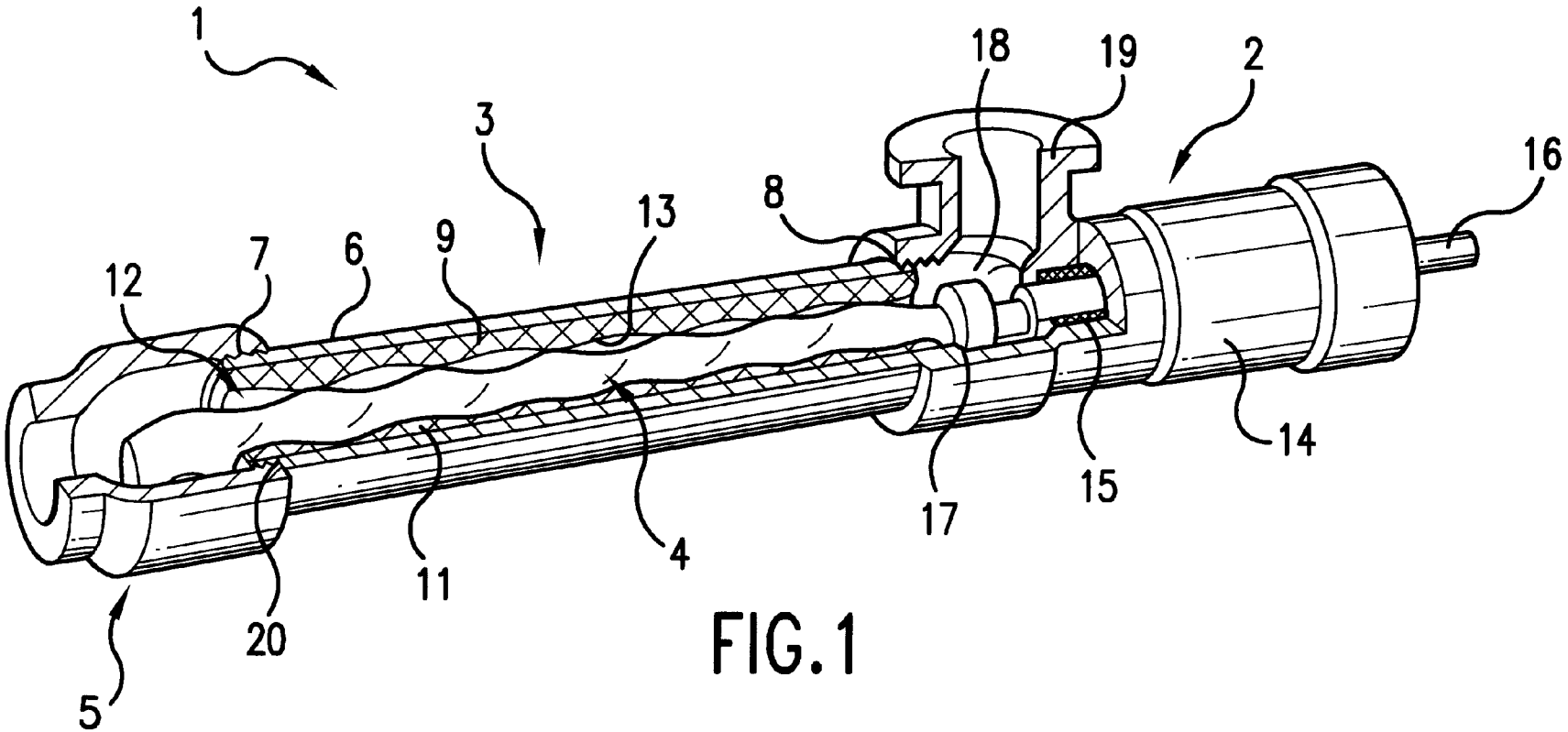
FIG. 1 shows an eccentric screw pump in a perspective representation, partly in cutaway section.

FIG. 1 shows an eccentric screw pump 1 in a perspective representation, partly in cutaway section. The eccentric screw pump 1 includes a pump head 2, a stator 3, a rotor 4 running in the stator 3, and a nozzle 5.

The stator 3 consists of a tubular, cylindrical stator shell 6, for example made of steel, which is provided at both ends with connecting threads 7, 8. The stator shell 6 forms a cylindrical smooth inner surface 9, on which a stator lining 11 made of an elastomeric material is vulcanized. The lining 11 defines a through-opening 12 having a helically running inner wall 13. The through-opening 12 extends through the entire stator 3 and is coaxial to its outer contour, in particular to its connecting threads 7 and 8.

The helical inner wall 13 forms a multiple-start thread, in which case the number of helices is larger by one than the number of thread helices of the rotor 4 and a multiplicity of helically wound strips which project radially inward are correspondingly produced.

Instead of using a stator shell 6 which has a cylindrically smooth inner wall 13, a stator shell 6 which itself has a helically wound inner contour may also be used. In this case, the elastomeric lining 11 has a constant wall thickness as viewed over the length of the stator 3. Higher pressures can be produced with the latter type of stator. However, since the configuration of the stator 3 is not a subject matter of the invention in the present case, a cursory explanation is sufficient in this respect.

The pump head 2 has a housing 14 with a sealed-off through-bore 15 for a drive shaft 16 running therein. The drive shaft 16 is to be set in rotation by means of a drive motor (not shown) and is coupled to the rotor 4.

At its front end, the housing 14 is provided with an internal thread 17, into which the stator 3 is screwed with the connecting thread 8. The bearing bore 15 is in coaxial alignment with the through-opening 12 of the stator 3.

A feed chamber 18, into which a connection 19 coming from outside opens, is located between the stator 3 and the start of the bearing bore 15.

Finally, the nozzle 5 is screwed onto the outlet-side end of the stator 3, this nozzle consisting of an essentially tubular part having an internal thread 20.

Instead of the external threads 7 and 8 shown, the nozzle 5 and the pump housing 14 may also be connected to the stator 3 via appropriate internal threads, or the at [sic] parts are connected to one another via tie rods and the stator 3 is clamped in place between them.

Figure 2:
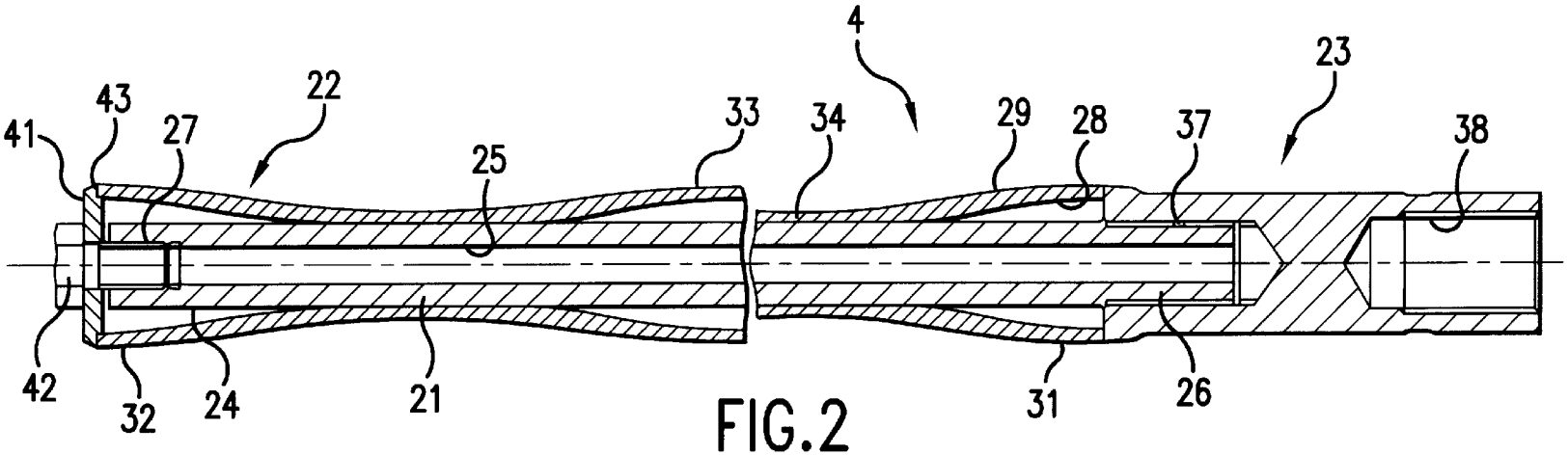
FIG. 2 shows the rotor of the eccentric screw pump according to FIG. 1 in a longitudinal section.

The construction of the stator 3 [sic] is explained below with reference to FIGS. 2 and 3:

As can be seen from FIG. 2, the stator 3 [sic] is composed of a core element 21, a stator [sic] shell 22 and a coupling head 23.

In the exemplary embodiment shown, the core element 21 is a thick-walled steel tube having an at least originally cylindrical outer circumferential surface 24 and a continuous cylindrical interior space 25.

The core element 21 is straight and is of tubular design because the interior space does not contribute significantly to the strength, which is important here, but merely increases the weight. However, it may also be solid.

At its right-hand end in FIG. 2, the core element 21 is provided with a threaded stem 26, onto which the coupling head 23 is screwed. At the opposite end, the core element 21 contains a tapped hole 27.

The shell 22 of the rotor 4 is likewise a tube having an inner wall 28 and an outer surface 29. The shell 22 is formed helically by a cold forging process as described, for example, in DE-A-17 03 828. The outer wall 29 forms a thread which extends over the entire axial length of the shell 22. It starts at 31 and ends at 32. The number of helices of the thread formed by the outer surface 29 is one less than the number of helices of the through-opening 12 in the stator 3.

Figure 3:
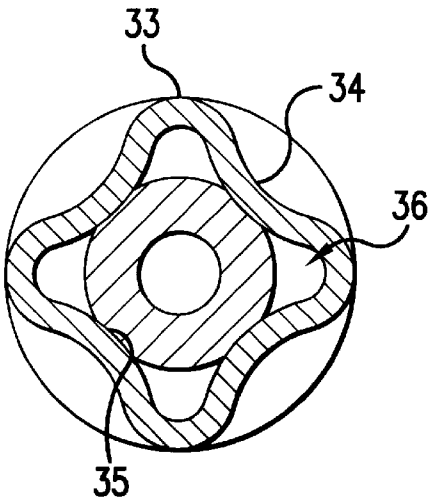
FIG. 3 shows the rotor according to FIG. 2 in a section along line III—III.

As can be seen from the cross section in FIG. 3, the rotor 4, in the exemplary embodiment shown, has a four-start thread; i.e. a total of four strips run helically along the shell 22. Since the through-opening 12 is accordingly five-start, the five-start thread in the through-opening 12 forms a total of five helically extending strips of elastomeric material.

As already mentioned, the shell 22 is tubular, for which reason the inner surface 28 follows the outer surface 29 at a constant distance.

As a result of the shell 22 being formed helically, its outer surface 29, as viewed in the longitudinal direction, alternately forms thread crests 33 and thread valleys 34. As a result of the multiple number of starts, the thread valleys 34 and thread crests 33 appear not only in the longitudinal direction but also, as the cross section according to FIG. 3 shows, in the circumferential direction in every sectional plane.

The dimensions of the cylindrical straight tube, from which the shell 22 is cold-worked, are selected such that, after the final shaping to produce the helical form, the shell 22, with its inner circumferential surface 28, at least touches the outer circumferential surface 24 of the core element 21 in the region of the thread valleys 34 (with respect to the outer contour).

Given an appropriately greater degree of shaping, it is also possible to additionally shape the outer circumferential surface 24 of the core element 21 to a small degree, as a result of which the outer circumferential surface 24 is given shallow grooves 35 which follow the contour of the thread valleys 34. If the shaping is continued in this way, not only a frictional connection but also a positive-locking connection is produced between the shell 24 and the core element 21 in the region of the thread valleys 34 arching toward the interior of the shell 22. In addition, as a result of the shaping, even cold welding may be effected between the shell 22 and the core element 21 at the contact points.

Since, as mentioned, the semifinished product from which the shell 22 is manufactured is a cylindrical tube whose diameter is greater than the outside diameter of the core element 21, helically running intermediate spaces 36 are produced between the core element 21 and the shell 22. The number of these helical intermediate spaces 36 is equal to the number of thread crests 33, which can be seen in the circumferential direction in the cross section of the rotor 4. Depending on the application, these intermediate spaces 36 may either remain empty or be filled with a mass. This mass may be, for example, synthetic resin or synthetic resin filled with light-alloy powder, cast metal or sintered metal.

The drive head 32 is a machined cylindrical turned part having two tapped blind holes 37 and 39. With the tapped blind hole 37, the drive head 23 is screwed onto the threaded stem 26 and serves to connect the rotor 4 to the draft shaft 16. Instead of the blind hole 38, other driver means are also suitable. In deviation from the connection shown, the drive head 32 may also be screwed into a tapped hole in the core element 21.

In order to prevent the drive head 23 from being released from the rotor 4, the thread direction of the threaded stem 26 is opposed to the thread direction of the screw formed on the shell 22. In addition, the drive head 23 may be welded to the shell 22 in a liquid-tight manner, as a result of which the torsional strength between the drive head 23 and the shell 22 is also increased. If the shell 22, for example, has a multi-start right-hand screw, the thread of the threaded stem 26 is a left-hand thread. The same accordingly applies to the thread in the tapped blind hole 37.

Finally, in order to fix the shell 22 relative to the core element 22 [sic] on the runout or pressure side, a disc-shaped spacer element 41 is provided, which is fixed by means of a screw 42 which is screwed into the internal thread 27. By means of an appropriately contoured shoulder 43 and an appropriately shaped short extension, the spacer element 41 fixes the core element 21 in the radial direction with respect to the shell 22. Instead of the screwed connections shown, the spacer element 41 may be welded to both the core element 21 and the shell 22.

The rotor 4 shown is produced by the tubular core element 21 and the tube which forms the shell 22 being passed coaxially and simultaneously through the cold-working arrangement according to DE-A-17 03 828. As a result, the helically wound shell 22 is cold forged from the cylindrical outer tube. On the other hand, the core element 21, apart from the shallow grooves 35, remains essentially in a state in which it is not worked at all. After the cold-forging operation, the component obtained is shortened to the desired length, and the threaded stem 26 is produced by thread whirling or by turning and subsequent thread cutting or rolling.

As is normally the case in eccentric screw pumps, the stator 3 produced by cold working has a straight axis.

The cold forging achieves a structure which is favorable with regard to the forces which occur.

With the construction described, and in the manner described, rotors in which the wall thickness of the shell 22 is between 2 and 20 mm can be produced. The overall outside diameter of the rotor 4 may be up to 300 mm, whereas the total length of the rotor 4 may extend up to 8 m. The large lengths are required for high delivery pressures in pumps or high torques in motors, as occur during delivery in the undersea or subsurface sector.

In the rotor 4, the core element 21 may be made of a different material from the shell 22. In addition, at least the shell 22 may be formed from a difficult-to-machine, but ductile material, e.g. V4A steel.

However, the rotor 4 described may not only be used in the eccentric screw pump shown in FIG. 1; on the contrary, it is also suitable in the same manner for motors which are constructed like eccentric screw pumps, for example subsurface drilling motors. By means of such an arrangement, hydraulic energy is converted into mechanical energy by a driving liquid being forced at high pressure through the "eccentric screw pump". As a result, the rotor 4 is set in rotation and driving power can be tapped at the shaft 16. Since the basic construction of the rotor 4 does not depend on whether it is used in combination with a subsurface drilling motor or an eccentric screw pump, it is not necessary to produce a basically identical section through a subsurface drilling motor in addition to the eccentric screw pump according to FIG. 1.

Figure 4:
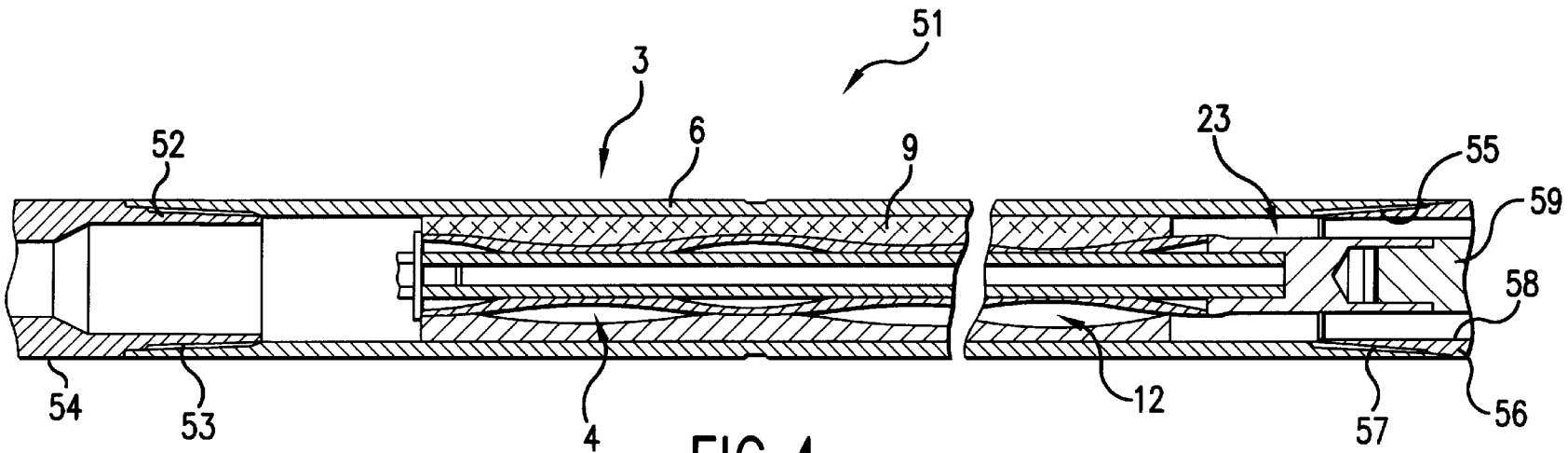
FIG. 4 shows a subsurface drilling motor in a longitudinal section.

FIG. 4 shows the use of the rotor 4 according to the invention in a subsurface drilling or mud motor 51. The basic construction of the subsurface drilling motor 51 is in principle similar to the construction of an eccentric screw pump, as shown in FIG. 1.

Whereas mechanical energy is converted into hydraulic energy in the eccentric screw pump, the opposite energy conversion takes place in the subsurface drilling motor 51. Liquid under high pressure is admitted to the subsurface drilling motor 51, as a result of which its rotor 4 is set in rotation.

In so far as there are structural elements in the subsurface drilling motor 51 which have already been explained in connection with FIGS. 1 to 3, no detailed description is given again.

The subsurface drilling motor 51 has a stator 3, which in turn consists of a cylindrical steel tube 6 as shell having an elastomeric lining 9. At the inlet-side end of the stator 3, the stator shell 6 is provided with a tapered internal thread 52, into which a hydraulic coupling piece 54 having a continuous passage is screwed by means of a tapered external thread 53.

The coupling piece 54 is tubular and serves to feed the driving liquid into the subsurface drilling motor 51. The outlet-side end of the stator 3 is likewise provided with a tapered internal thread 55, into which an outlet nozzle 56 is screwed. To this end, the outlet nozzle 56 has a corresponding tapered external thread 57 and likewise contains a continuous passage 58.

The outlet nozzle 56 at the same time serves as a mounting for an output shaft 59, which is connected to a drilling bit (not illustrated). The outside diameter of the output shaft 59 is smaller than the clear width of the passage 58 in the outlet nozzle 56. In this way, the liquid passing through the subsurface drilling motor 51 can discharge in the direction of the drilling bit and be used at the same time as drilling mud.

The coupling head 23 connects the rotor 4 to the output shaft 58.

The basic construction of the rotor 4 does not differ from the construction of the rotor 4 according to FIGS. 2 and 3, for which reason explanation is not necessary again at this point.

The subsurface drilling motor 51 according to FIG. 4 works in such a way that liquid under high pressure, for example drilling mud, as used in the subsurface sector, is fed via the hydraulic coupling piece 54. The fluid under pressure penetrates into the pump chambers, which are formed between the rotor 4 and the inner lining 9 of the stator 3. The pressure of the liquid attempts to enlarge the chamber, as a result of which the rotor 4 is set in rotation in the stator 3. Since as many chambers as possible are intended to be open on the inlet side of the subsurface drilling motor 51, these chambers being formed between the stator 3 and the rotor 4, a rotor 4 which is used for motor purposes has significantly more thread helices than a rotor 4 which is used for pump purposes. Since the number of thread helices in the stator 3 is in each case greater by one than the number of thread helices of the rotor 4, the number of thread helices in the stator 3 in a subsurface drilling motor 51 is also significantly greater than in the eccentric screw pump 1 according to FIG. 1.

The axial length of an undivided subsurface drilling motor 51 may be up to 8 m. If greater lengths are required, a plurality of subsurface drilling motors 51 shown in FIG. 5 [sic] are connected one behind the other, in which case the rotor 4 of the subsequent motor stage is then provided at both ends with the threaded stems 26 in order to produce the coupling with the upstream rotor 4, on the one hand, and with a downstream further rotor 4 or the tool.

Figure 5:
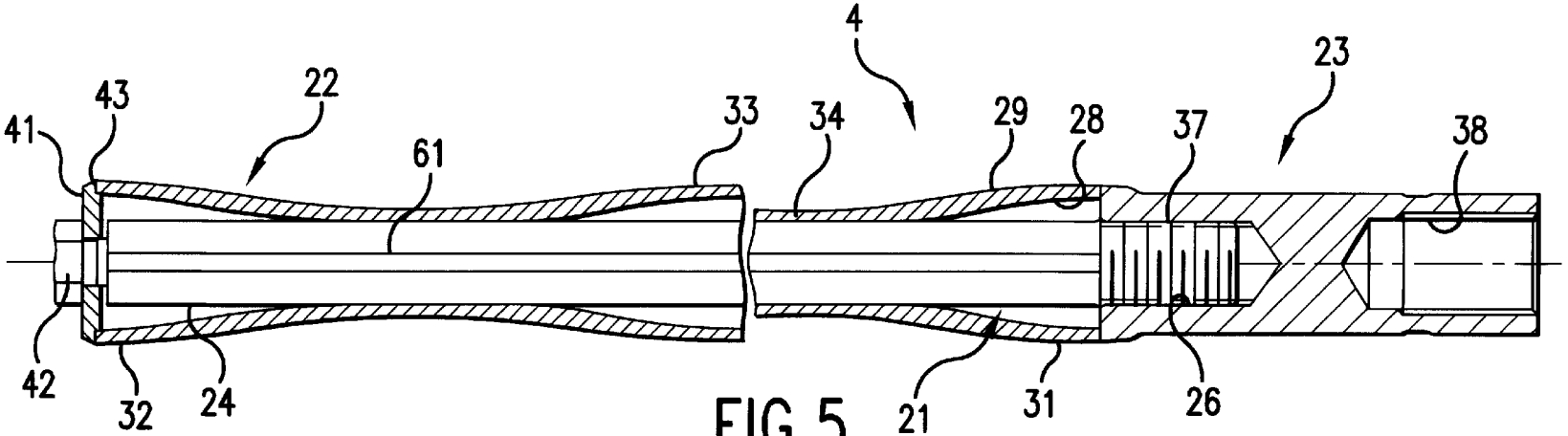
FIG. 5 shows another exemplary embodiment of the rotor of the eccentric screw pump according to FIG. 1 in a longitudinal section.
Figure 6:
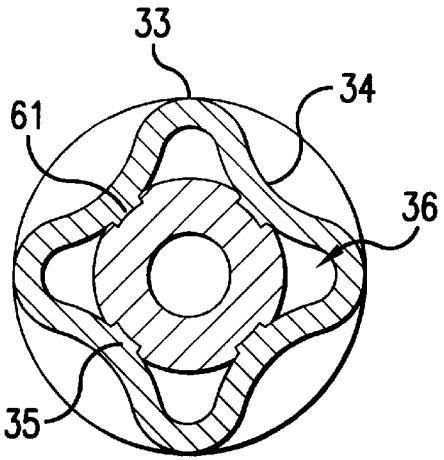
FIG. 6 shows the rotor according to FIG. 5 in a cross section similar to FIG. 3.

FIGS. 5 and 6 show a rotor 4 similar to the rotor according to FIG. 2 in each case in a longitudinal section and a cross section.

The construction is virtually identical, for which reason the same reference numerals, without renewed explanation, are used for parts and design features already described.

The essential difference from the rotor according to FIG. 2 consists in the fact that the core element 21, in its cylindrical outer circumferential surface 24, in the exemplary embodiment shown, contains a total of four straight grooves 61 which are continuous in the longitudinal direction. As can be seen from the cross section according to FIG. 6, the grooves 61 have a rectangular cross section with a depth of about 0.5 mm. The width of the groove 61 measured in the circumferential direction is about 5 mm.

Production is carried out as explained in connection with FIG. 2. Due to the cold-forging process or drawing process, the material of the shell 22 in the region of the thread valleys 34 flows into the grooves 61 during the cold working, specifically at the locations at which the inside of the shell 22 which arches inward in the region of the thread valleys 34 intersects the grooves 61. Since the shell 22 forms a four-start screw on its outside, a total of four thread helices run over the length of the rotor 4. The thread helices form corresponding inwardly pointing convex surfaces, the course of which intersects the grooves 61 at the helix angle of the respective thread helix. In the exemplary embodiment shown, a thread helix intersects one of the grooves 61 every 90°. The number of grooves 61 may also be greater than the number of thread helices of the rotor 3.

Since the material of the shell 22 flows into the groove 61 during the cold working, a positive-locking connection is produced between the shell 22 and the core element 21.

Since the course of the grooves 61 does not follow the course of the thread valleys but has a different angle, the core element 22 [sic] cannot be unscrewed from the shell 22 even if force is used.

The embodiment shown having straight grooves 61 is especially simple with regard to the production of the core element 21. However, it is also possible to provide the grooves 61 as helically running grooves, the grooves expediently forming a screw which run [sic] in opposition to the screw of the thread helices; i.e., if the shell 21 [sic] forms a right-hand screw on its outside, the grooves on the core element 22 [sic] form a left-hand screw. In order to further increase the strength of the connection between the shell 22 and the core element 21, the pitch may be selected such that the grooves 61 lie at right angles to the thread valleys 34.

There is very high torsional strength on account of the positive-locking connection between the shell 22 and the core element 21. The rectangular cross section of the grooves 61 prevents the material of the shell 22 which is forced into the grooves 61 from coming out of the grooves 61 or from pushing out the thread valleys 34 if shearing forces come into effect between the core element 21 and the shell 22.

A rotor (4) for an eccentric screw pump (1) or a subsurface drilling motor (51) consists of a straight, essentially cylindrical core element (21), onto which a shell (22) is forged by a cold-forging process. The forging gives the shell (22) the helical external form required for eccentric screw pumps (1). The rotor (4) described can be produced by non-cutting shaping, which is of considerable advantage in particular in the case of large rotor dimensions, since no waste material is produced.

I claim:

1. Rotor (4) for an eccentric screw pump (1) or an eccentric screw motor (51), which pump or motor has a stator (3) having a continuous interior space (12), into which strips project radially and in which the rotor (4) is arranged, having an essentially cylindrical core element (21), having an outer shell (22) which forms a helically formed outer surface (29) and surrounds the core element (21) essentially over its entire length, and the outer surface of which has thread valleys (34) and thread crests (33), the shell (22) being connected to the core element (21) by a cylindrical tube which forms the shell (22), being formed by shaping it into a helical tube until the shell bears with its inner circumferential surface in the region of the thread valleys against the core element and being frictionally connected to the core element (21) in the region of at least one thread valley, and having a coupling head (23) which is connected to the rotor (4) in a rotationally locked manner.

2. Rotor according to claim 1, characterized in that the rotor (4) forms a single start or multiple-start thread.

3. Rotor according to claim 1, characterized in that the shell (22) is made of a different material from the core element (21).

4. Rotor according to claim 1, characterized in that the shell (22) is tubular over its entire length.

5. Rotor according to claim 1, characterized in that the shell (22) has essentially the same wall thickness over its entire length and its entire circumference.

6. Rotor according to claim 1, characterized in that the shell (22) is in contact with the core element (21) only in sections.

7. Rotor according to claim 1, characterized in that the shell (22) is connected to the core element (21) in a positive-locking manner only in the region of the at least one thread valley (34).

8. Rotor according to claim 7, characterized in that the positive-locking connection is formed by at least one groove (61), which follows the course of the at least one thread valley of the shell (22) and into which the inside of the shell (22) projects in the region of the at least one thread valley.

9. Rotor according to claim 8, characterized in that the groove (61) is formed during the shaping of the tube forming the shell (22).

10. Rotor according to claim 8, characterized in that the core element (21) contains at least one groove (61) in at least one section of its longitudinal extent, the course of which groove, (61) differs from the course of the at least one thread valley.

11. Rotor according to claim 8, characterized in that the groove (61) has a rectangular cross section.

12. Rotor according to claim 8, characterized in that the groove (61) extends over the entire length of the core element (21).

13. Rotor according to claim 8, characterized in that the groove (81) [sic] is a straight groove which runs along the generating line of the core element (21).

14. Rotor according to claim 8, characterized in that the groove (61) is a helical groove.

15. Rotor according to claim 1, characterized in that the shell (22) is connected to the core element (21) by the cylindrical tube which forms the shell (22) being formed by cold working.

16. Rotor according to claim 1, characterized in that there is at least one helically running intermediate space (36) between the core element (21) and the shell (22).

17. Rotor according to claim 16, characterized in that the at least one helically running intermediate space (36) is filled with a mass.

18. Rotor according to claim 16, characterized in that the at least one helically running intermediate space (36) is empty.

19. Rotor according to claim 1, characterized in that the core element (21) is tubular.

20. Rotor according to claim 1, characterized in that the core element (21) is solid.

21. Rotor according to claim 1, characterized in that the core element (21), at least at one front end, forms a stem (26) projecting beyond the shell (22).

22. Rotor according to claim 21, characterized in that the stem (26) is connected to the coupling head (23) in a rotationally locked manner.

23. Rotor according to claim 21, characterized in that the stem (26) is a threaded stem, and in that the coupling head (23) contains a tapped hole (38).

24. Rotor according to claim 21, characterized in that the thread of the threaded stem (26) has a different number of starts from the rotor (4).

25. Rotor according to claim 1, characterized in that the core element (21), at one end, is connected to the shell (22) via a radially acting centering piece (41).

26. Eccentric screw pump, characterized in that it contains a rotor (4) according to claim 1.

27. Eccentric screw motor (51), characterized in that it contains a rotor (4) according to claim 1.

28. Subsurface drilling motor (51) which has a stator (3) having a continuous interior space (12), into which strips project radially, characterized in that it contains a rotor (4) according to claim 1.

* * * * *